US005107864A

United States Patent [19]

Owens, Jr.

[11] Patent Number: 5,107,864

[45] Date of Patent: Apr. 28, 1992

[54] WRAPPER FOR SMOKING ARTICLE, SMOKING ARTICLE, AND METHOD OF MAKING SAME

[75] Inventor: William F. Owens, Jr., Pisgah Forest, N.C.

[73] Assignee: P. H. Glatfelter Company, Spring Grove, Pa.

[21] Appl. No.: 656,497

[22] Filed: Feb. 19, 1991

[51] Int. Cl.[5] ..... A24D 1/02

[52] U.S. Cl. ..... 131/365; 131/335

[58] Field of Search ..... 131/365, 335; 162/139

[56] References Cited

U.S. PATENT DOCUMENTS

| | | | |
|---|---|---|---|
| 3,744,496 | 7/1973 | McCarty et al. | 131/365 |
| 4,231,377 | 11/1980 | Cline et al. . | |
| 4,450,847 | 5/1984 | Owens | 131/365 |
| 4,461,311 | 7/1984 | Mathews et al. . | |
| 4,804,644 | 2/1989 | Anseau et al. . | |
| 4,881,557 | 11/1989 | Martin . | |
| 4,915,118 | 4/1990 | Kaufman et al. . | |

OTHER PUBLICATIONS

Tobacco Flavoring for Smoking Products by Leffingwell et al., Published by R. J. Reynolds Co., in 1972, Winston Salem, N.C., pp. 1, 11-14, 17, 61-64.

*Primary Examiner*—V. Millin

*Attorney, Agent, or Firm*—Kerkam, Stowell, Kondracki & Clarke

[57] ABSTRACT

A wrapper for a smoking article which, when wrapped about a tobacco column, provides improved sidestream smoke reduction, improved ash formation, and improved mainstream smoke taste and sidestream smoke odor subjectives. These objectives are attained by forming a single cellulosic sheet containing a filler combination of magnesium hydroxide activated carbon, and calcium carbonate. In addition, the sheet may be treated with a burning chemical such as potassium citrate, an organic acid such as citric acid, and a sugar such as sucrose. Considerable latitude exists in regard to sheet basis weight, filler levels, sheet porosity, burn rate and size press solution treatment in order to optimize product requirements.

9 Claims, No Drawings

WRAPPER FOR SMOKING ARTICLE, SMOKING ARTICLE, AND METHOD OF MAKING SAME

SUMMARY OF THE INVENTION

This invention relates to a smoking article wrapper which, when provided with a suitable tobacco column, produces less particulate sidestream smoke than do cigarettes fabricated with conventional cigarette paper wrappers, produces a well formed ash which clings tightly without premature flaking and burns at an acceptable rate, and to methods of producing same.

BACKGROUND OF THE INVENTION

The reduced sidestream smoke cigarette paper patents which describe magnesium oxide/hydroxide as paper fillers, which are assigned to Olin Corporation, Ecusta Corporation or P. H. Glatfelter Company, and which disclose burning chemical types and levels are U.S. Pat. Nos. 4,231,377; 4,450,847; 4,881,557; and 4,915,118. These patents claim alkali metal acetates, citrates, nitrates, carbonates and tartrates as burning chemical types at levels in the sheet ranging from 0.5% to 8.0%.

The Kimberly-Clark Corporation and Cookson Group, plc patents dealing with reduced sidestream smoke cigarette paper are U.S. Pat. Nos. 4,461,311 and 4,804,644. These patents disclose the use of sodium and potassium salts of carbonic, formic, acetic, propionic, malic, lactic, glycolic, citric, tartaric, fumaric, oxalic, malonic, nitric, and phosphoric acids at levels in the sheet up to 16% by weight (levels up to 25% are also disclosed) and high superficial surface area, thermally stable fillers.

U.S. Pat. No. 3,744,496, assigned to Olin Corporation, discloses a carbon-filled paper to wrap cigarettes and/or cigars, preferably used as an inner liner, with regular cigarette paper or cigar wrapper as an outer wrap.

OBJECTS OF THE INVENTION

The purpose of this invention is to provide a cigarette paper or cigar wrapper which, when fabricated into a cigarette or cigar with a suitable tobacco column, statically burns at an acceptable rate, produces a light-colored, well formed ash which clings tightly without premature flaking, delivers both mainstream and sidestream smoke with a subjectively pleasant taste and aroma, and has significantly reduced sidestream smoke. More specifically, these desirable properties are achieved by a mixture of magnesium hydroxide, activated carbon and calcium carbonate to produce a base cigarette paper or cigar wrapper, and this paper is subjected to treatments as described in U.S. patent application Ser. No. 514,333, filed Apr. 26, 1990, (acid treatment) and Ser. No. 514,885, filed Apr. 26, 1990, (sugar addition). Further sidestream aroma and mainstream taste improvements may be effected by absorption onto all or part of the activated carbon such flavorants as menthol, vanillin, ethyl vanillin, propenyl guaethol, and glycyrrhiza which are released by the heat of the burning zone to enter the sidestream and mainstream smoke.

DETAILED DESCRIPTION OF THE INVENTION

It has been found that by putting activated carbon in the furnish of the paper, along with magnesium hydroxide and calcium carbonate, and incorporating the teachings of U.S. patent applications Ser. No. 514,533 (acid treatment) and Ser. No. 514,885 (sugar addition), an enhancement in sidestream smoke reduction is obtained over magnesium hydroxide/calcium carbonate only, while obtaining a significant improvement in ash properties and mainstream taste subjectives. The resulting cigarette is distinctly light to dark gray in color, depending on the particle size and level of carbon in the paper. The truly novel findings in this work are the improvements in sidestream smoke reduction, ash, and subjective taste properties of cigarettes wrapped in papers containing a mixture of magnesium hydroxide, activated carbon and calcium carbonate over the same papers with only magnesium hydroxide and calcium carbonate or activated carbon and calcium carbonate fillers.

| PARAMETERS OF THE INVENTION | |
|---|---|
| Carbon content: | 2.0 to 40% |
| Preferred | 5.0 to 25% |
| Magnesium Hydroxide content: | 2.0% to 35% |
| Preferred | 5.0% to 20% |
| Calcium Carbonate content: | 5.0% to 40% |
| Preferred | 10% to 30% |
| Basis Weight: | 25 gm/m$^2$ to 100 gm/m$^2$ |
| Preferred | 35 gm/m$^2$ to 65 gm/m$^2$ |
| Porosity: | 1 to 25 Coresta |
| Preferred | 5 to 12 Coresta |
| Burning Chemical: | Alkali metal salts of organic or inorganic acids selected from the group consisting of citric, malic, lactic, glycolic, tartaric, fumaric, maleic, malonic, glutaric, adipic, acetic, succinic, hydrochloric and phosphoric. |
| Burning Chemical Addition Rate: | 0.5% to 6.0% |
| Acid Addition Rate: | 1.0% to 10% acid compatible with the alkali metal salt burning chemical. |
| Sugar Addition Rate: | 1.0% to 10% mono-, di-, tri- or poly-saccharides. |
| Flavorant: | Adsorbed onto the carbon. |
| Smoking Articles: | Cigarettes, cigars, and the like. |

The size of the particles of the incorporated activated carbon is significant in that the smaller the particles, the darker the finished paper sheet, and if the particles are too large, they cause "sparking" which would not be tolerable in a commercial smoking article.

The preferred particle size (by ASTM method E-11) measured on an air-jet sieve would be 98+% through 325 mesh. Questionable particle size would be larger than 8.4% on 200 mesh, 25.6% on 325 mesh, and 65.1% through 325 mesh.

TABLE I

TASTE SUBJECTIVES

Cigarette Base Paper: 10% Magnesium Hydroxide; 10% Activated Carbon (North American Carbon Co.) (98.6%, 325 mesh) GX248; 20% Calcium Carbonate; Porosity = 9 Coresta; Basis Weight = 45 gm/m$^2$ Test Cigarettes - Commercial 100 mm "Lights" brand with standard paper removed and replaced with the experimental reduced-sidestream-smoke cigarette papers.

| Additive/Burning Chemical | Odor/Taste Results | Subjective Preference |
|---|---|---|
| 1) 5.6% Potassium Citrate | Cigar type aroma | 5 |

TABLE I-continued

| TASTE SUBJECTIVES | | |
|---|---|---|
| | Harsh After Taste | (worst) |
| 2) 5.6% Potassium Citrate + 2.3% Citric Acid | Normal Aroma Less Harsh Less After Taste | 3 |
| 3) 5.6% Potassium Citrate + 6.0% Sucrose | Cigar Aroma Less Harsh Less After Taste | 4 |
| 4) 5.6% Potassium Citrate + 2.3% Citric Acid + 4.5% Sucrose | Normal Aroma Smooth No After Taste | 1 (best) |
| 5) 5.6% Potassium Citrate + 2.3% Citric Acid + 6.0 Sucrose | Normal Aroma Peppery No After Taste | 2 |

It is observed from the above study that the addition of both citric acid and sucrose to the base paper containing magnesium hydroxide, activated carbon, and calcium carbonate gives improvements in sidestream aroma and mainstream taste, and when the two are combined, the best products are produced in terms of subjective taste and aroma properties.

effected by burning chemical type and level, basis weight, sheet porosity, filler type and level, and the type and level of magnesium hydroxide in the paper.

TABLE III

ASH PROPERTIES

Test Cigarettes - Commercial 100 mm "Lights" brand with standard paper removed and replaced with the experimental reduced-sidestream-smoke cigarette papers.

| Cigarette Paper | Static Ash | Puffed Ash |
|---|---|---|
| Control[1] | Tight shrinkage | Tight shrinkage |
| | Light gray | Light gray |
| | No flake fall-off | No flake fall-off |
| | Solid sheath | Small adhering flakes |
| $Mg(OH)_2$ - 35%[2] | Outward flare | No shrinkage |
| | Light gray | Light gray |
| | Total ash fall-off | Moderate flake fall-off |
| | Cracked sheath | Cracked sheath |
| $Mg(OH)_2$ - 10%[3] | No shrinkage | Tight shrinkage |
| | Light gray | Light gray |
| | Minimal flake fall-off | No flake fall-off |
| | Cracked sheath | Cracked sheath |
| $Mg(OH)_2$ - 10%[4] | Tight shrinkage | Tight shrinkage |
| Carbon - 10% | Light gray | Light gray |
| | No flake fall-off | No flake fall-off |
| | Solid sheath | Small adhering flakes |

[1]Ecusta 12556 Cigarette Paper: 30% Calcium Carbonate, 25 Coresta Porosity, 25 gm/m$^2$, 0.55% Citrate burning chemicals.

[2]35% Magnesium hydroxide, 5% Calcium Carbonate-filled 45 gm/m$^2$ paper treated to contain 5.6% potassium citrate, 2.3% citric acid, and 6.0% sucrose, 10 Coresta porosity.

TABLE II

SIDESTREAM REDUCTION

Test Cigarettes - Commercial 100 mm "Lights" brand with standard paper removed and replaced with the experimental reduced-sidestream-smoke cigarette papers.

| Cigarette Paper | Basis weight gm/m$^2$ | % $CaCO_3$ | % $Mg(OH)_2$ | % Carbon | Coresta Porosity | SBR[1] | SSGR[2] | TSS[3] |
|---|---|---|---|---|---|---|---|---|
| Control - Ecusta 12556 | 25 | 30 | 0 | 0 | 25 | 56.7 | 2.13 | 28.3 |
| Heavyweight + 1% $K_3$ Citrate | 45 | 20 | 0 | 0 | 9 | 50.7 | 1.46 | 20.2 |
| LSS - $Mg(OH)_2$[4] | 45 | 30 | 10 | 0 | 9 | 56.7 | 0.99 | 13.2 |
| LSS - $Mg(OH)_2$/Carbon[4] | 45 | 25 | 10 | 5 | 9 | 55.8 | 0.91 | 13.0 |
| LSS - $Mg(OH)_2$/Carbon[4] | 45 | 20 | 10 | 10 | 9 | 50.9 | 0.79 | 12.1 |
| LSS - $Mg(OH)_2$/Carbon[4] | 45 | 15 | 10 | 15 | 9 | 45.6 | 0.71 | 11.2 |
| LSS - $Mg(OH)_2$/Carbon[4] | 45 | 10 | 10 | 20 | 9 | 41.4 | 0.62 | 11.6 |
| LSS - $Mg(OH)_2$/Carbon[4] | 45 | 20 | 10 | 10 | 18 | 61.7 | 0.99 | 12.4 |
| LSS - $Mg(OH)_2$/Carbon[4] | 45 | 15 | 10 | 15 | 13 | 59.3 | 0.80 | 10.4 |
| LSS - $Mg(OH)_2$/Carbon[4] | 35 | 20 | 10 | 10 | 9 | 43.3 | 0.78 | 14.1 |
| LSS - $Mg(OH)_2$/Carbon[4] | 55 | 20 | 10 | 10 | 9 | 53.7 | 0.74 | 11.2 |
| LSS - Carbon[4] | 45 | 30 | 0 | 10 | 18 | 65.2 | 1.03 | 12.6 |

[1]SBR = Static Burn Rate - mg/min

[2]SSGR = Sidestream Generation Rate - mg/min

[3]TSS = Total Sidestream - mg/cigarette

[4]Burning Chemical Content = 5.6% potassium citrate, 2.3% citric acid, 6% sucrose

[3]10% magnesium hydroxide, 30% calcium carbonate-filled 45 gm/m$^2$ paper treated to contain 5.6% potassium citrate, 2.3% citric acid, and 6.0% sucrose, 9 Coresta porosity.

[4]10% magnesium hydroxide, 10% activated carbon, 20% calcium carbonate-filled 45 gm/m$^2$ paper treated to contain 5.6% potassium citrate, 2.3% citric acid, and 6.0% sucrose, 9 Coresta porosity.

COMMENTS - TABLE II

In reviewing Table II results, it will be observed that the combination of magnesium hydroxide/carbon/calcium carbonate-filled papers are giving the greatest sidestream smoke reductions, as judged by the sidestream smoke generation rate (SSGR)—being greater as the level of carbon in the paper is increased. Previous studies have shown the sidestream reduction also increases with the increase in the level of magnesium hydroxide, but the overall subjective ash properties decline with increases in the magnesium hydroxide level. The total sidestream tar (TSS) is greatly influenced by the burn rate of the cigarette and is higher the slower the static burn rate. Burn rate control can be

COMMENTS - TABLE III

It will be observed in reviewing Table III results, the combination of magnesium hydroxide/carbon/calcium carbonate-filled paper is giving ash properties very similar to that obtained with regular (control) cigarette paper with no significant differences being observed between these two papers.

TABLE IV

ADSORBED FLAVORANT

Test Cigarettes - Commercial 100 mm "Lights" brand with standard paper removed and replaced with the experimental reduced-sidestream-smoke cigarette papers.

| | Sidestream Reduction | | | | Taste/Aroma | |
|---|---|---|---|---|---|---|
| Cigarette Paper | Porosity | SBR[1] | SSGR[2] | TSS[3] | Taste | Aroma |
| Vanillin[4] | 9 | 48.2 | 0.78 | 12.2 | Very low vanillin | Mild vanillin |

TABLE IV-continued

ADSORBED FLAVORANT
Test Cigarettes - Commercial 100 mm "Lights" brand with standard paper removed and replaced with the experimental reduced-sidestream-smoke cigarette papers.

| | Sidestream Reduction | | | | Taste/Aroma | |
|---|---|---|---|---|---|---|
| Cigarette Paper | Porosity | SBR[1] | SSGR[2] | TSS[3] | Taste | Aroma |
| Ethyl Vanillin 10%[5] | 9 | 47.4 | 0.77 | 12.3 | Low vanillin | Strong vanillin |
| Propenyl Guaethol[6] | 8 | 43.1 | 0.64 | 11.5 | Low sweet | Sweet |
| Ethyl Vanillin 5%[7] | 9 | 46.9 | 0.74 | 12.3 | Very low vanillin | Mild Vanillin |

[1]Static Burn rate - mg/min.
[2]SBR = Sidestream Generation Rate - mg/min.
[3]TSS = Total Sidestream Tar - mg/cigarette
[4]Activated Carbon/Vanillin Preparation -- Dissolve 1.0 gm. Vanillin in 2.0 gm. 95% Ethyl Alcohol solution and add with constant stirring to 10.0 gms. of GX203 Activated Carbon from North American Carbon, Inc.. Let stand in closed container overnight before using to prepare handsheets.
[5]Activated Carbon/Ethyl Vanillin - 10% Preparation. Same as footnote 4, except Ethyl Vanillin is used in place of Vanillin.
[6]Activated Carbon/Propenyl Guaethol Preparation. Same as footnote 4, except Propenyl Guaethol is used in place of Vanillin.
[7]Activated Carbon/Ethyl Vanillin - 5% Preparation. Same as footnote 4, except only 0.5 gms. of Ethyl Vanillin is used in place of the Vanillin.

I claim:

1. A wrapper for smoking articles such as cigarettes, cigars, and the like, comprising a cellulosic fiber sheet containing magnesium hydroxide, calcium carbonate and activated carbon; wherein the content of magnesium hydroxide is from 5.0% to 20%; the content of the calcium carbonate is from 10% to 30%; and the content of the activated carbon is from 5% to 25%; further including 1.0% to 10% of an appropriately compatible acid; and 1.0% to 10% mono-, di-, tri-, or poly-saccarides.

2. The wrapper, as defined in claim 1, further including 0.5% to 6.0% alkali metal salts of organic and inorganic acids selected from the group consisting of citric, malic, lactic, glycolic, tartaric, fumaric, maleic, malonic, glutaric, adipic, acetic, succinic, hydrochloric, and phosphoric.

3. A smoking article comprising a tobacco charge and a wrapper comprising a cellulosic fiber sheet containing magnesium hydroxide, calcium carbonate and activated carbon; wherein the content of magnesium hydroxide is from 5.0% to 20%; the content of the calcium carbonate is from 10% to 30% and the content of the activated carbon is from 5% to 25%; and further including 1.0% to 10% of an appropriately compatible acid, and 1.0 to 10% mono-, di-, tri-, or poly-saccarides.

4. The smoking article, as defined in claim 3, further including 0.5% to 6.0% alkali metal salts of organic or inorganic acids selected from the group consisting of citric, malic, lactic, glycolic, tartaric, fumaric, maleic, malonic, glutaric, adipic, acetic, succinic, hydrochloric and phosphoric.

5. A method for reducing the visible sidestream smoke emanating from a smoking article, improving the ash properties and improving the mainstream taste subjectives comprising wrapping the tobacco charge in a combustible cellulosic sheet containing magnesium hydroxide, calcium carbonate and activated carbon; wherein the content of magnesium hydroxide is from 5.0% to 20%; the content of the calcium carbonate is from 10% to 30% and the content of the activated carbon is from 5% to 25%; and further including 1.0% to 10% of an appropriately compatible acid; and 1.0% to 10% mono-, di-, tri-, or poly-saccharides.

6. The wrapper, as defined in claim 5, further including 0.5% to 6.0% alkali metal salts of organic or inorganic acids selected from the group consisting of citric, malic, lactic, glycolic, tartaric, fumaric, maleic, malonic, glutaric adipic, acetic, succinic, hydrochloric and phosphoric.

7. A wrapper for smoking articles such as cigarettes, cigars, and the like, comprising a cellulosic fiber sheet containing magnesium hydroxide, calcium carbonate and activated carbon; wherein the content of the magnesium hydroxide is from 2.0% to 40%; the content of the calcium carbonate is from 5.0% to 40%, and the content of the activated carbon is from 2.0% to 40%; and further including a flavorant adsorbed on the activated carbon, said flavorant selected from the group consisting of menthol, vanillin, ethyl vanillin, propenyl guaethol, and glycyrrhiza which is released by the heat of the burning zone to enter the sidestream and mainstream smoke.

8. A smoking article comprising a tobacco charge and a wrapper comprising a cellulosic fiber sheet containing magnesium hydroxide, calcium carbonate and activated carbon; wherein the content of magnesium hydroxide is from 2.0% to 40%; the content of the calcium carbonate is from 5.0% to 40%, and the content of the activated carbon is from 2.0% to 40%; and further including a flavorant adsorbed on the activated carbon, said flavorant selected from the group consisting of menthol, vanillin, ethyl vanillin, propenyl guaethol, and glycyrrhiza which is released by the heat of the burning zone to enter the sidestream and mainstream smoke.

9. A method for reducing the visible sidestream smoke emanating from a smoking article, improving the ash properties and improving the mainstream taste subjectives comprising wrapping the tobacco charge in a combustible cellulosic sheet containing magnesium hydroxide, calcium carbonate and activated carbon; wherein the content of magnesium hydroxide is from 2.0% to 40%; the content of the calcium carbonate is from 5.0% to 40% and the content of the activated carbon is from 2.0% to 40%; and further including absorbing a flavorant on the activated carbon, said flavorant selected from the group consisting of ethyl vanillin, propenyl guaethol, and glycyrrhiza which is released by the heat of the burning zone enter the sidestream and mainstream smoke.

* * * * *